US006025105A

United States Patent [19]

Rice et al.

[11] Patent Number: 6,025,105

[45] Date of Patent: Feb. 15, 2000

[54] TONER COMPOSITIONS AND USE

[75] Inventors: Steven M. Rice, Mitchell, S. Dak.; David Devonald, Manchester, United Kingdom; Shuitsu Sato, Kawasaki, Japan

[73] Assignee: Toshiba America Business Solutions, Inc., Irvine, Calif.

[21] Appl. No.: 09/025,568

[22] Filed: Feb. 18, 1998

[51] Int. Cl.[7] ..... G03G 9/097

[52] U.S. Cl. ..... 430/110; 430/108

[58] Field of Search ..... 430/106, 108, 430/110, 137

[56] References Cited

U.S. PATENT DOCUMENTS

| | | | |
|---|---|---|---|
| 4,206,064 | 6/1980 | Kiuchi et al. | 430/106 |
| 4,407,926 | 10/1983 | Stahlhofen | 430/165 |
| 4,624,907 | 11/1986 | Niimua et al. | 430/106 |
| 5,143,809 | 9/1992 | Kaneko et al. | 430/105 |
| 5,770,341 | 6/1998 | Mukudai et al. | 430/110 |
| 5,843,611 | 12/1998 | Sukata et al. | 430/110 |
| 5,856,055 | 1/1999 | Ugai et al. | 430/110 |

FOREIGN PATENT DOCUMENTS

| | | |
|---|---|---|
| 0 664 493 | 7/1995 | European Pat. Off. . |
| 769 530 | 5/1997 | European Pat. Off. . |
| 61-045229 | 3/1986 | Japan . |
| 62-1-1559 | 5/1992 | Japan . |
| 57-167033 | 9/1993 | Japan . |
| 61-155464 | 9/1993 | Japan . |
| 62-129358 | 9/1993 | Japan . |
| 62-255958 | 9/1993 | Japan . |
| 63-066263 | 9/1993 | Japan . |
| 63-202759 | 9/1993 | Japan . |
| 2 090 008 | 10/1981 | United Kingdom . |

OTHER PUBLICATIONS

CAS entry for the well known prior art CCA—Spilon Black TRH.

Extract relating to CCAs from the text book "Chemistry and Technology of Printing and Imaging Systems" edited by P. Gregory, published by Balckie Academic and Professional, 1996, ISBN 0–7514–238–9.

*Primary Examiner*—John Goodrow

*Attorney, Agent, or Firm*—Foley & Lardner

[57] ABSTRACT

A substantially chromium-free toner composition which comprises, as a negative charge control agent, one or more complexes of Formula 1:

Formula I

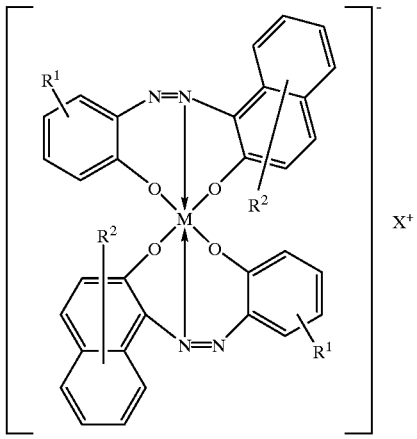

including other acceptable forms of such complex, in which: X+ is H+, Na+ or mixtures thereof; M is Fe or Co; $R^1$ is sulphonyl or sulphamoyl, substituted by one or more $C_{1-4}$ alkyl; and $R^2$ is carboxy or phenylcarbamoyl, optionally substituted by one or more $C_{1-4}$alkyl; but when $R_1$ is methylsulphonyl, $R^2$ is not carboxy.

13 Claims, No Drawings

TONER COMPOSITIONS AND USE

BACKGROUND OF THE INVENTION

The present invention relates to the field of electroreprography. In particular the invention relates to compositions with utility in electroreprography. The present invention, therefore, relates to novel toner compositions, containing certain charge control agents, which have superior properties which render them particularly useful in electroreprography.

Electroreprography is any process in which an image is reproduced by means of electricity and incident radiation, usually electromagnetic radiation more usually visible light. Electroreprography includes the technology of electrophotography which encompasses photocopying and laser printing technologies. In both these technologies a latent electrostatic image in charge is produced by exposure of a photoconductive drum to light. This can be either reflected light from an illuminated image (photocopying) or by scanning the drum with a laser usually under instruction from a computer (laser printing). Once a latent image has been produced in charge it must be developed with colorant so that a visible image can be printed onto paper.

Toner compositions are used to develop the latent image on the drum into a visual image. During use in an electroreprographic device friction between particles of toner, their carrier and/or parts of the device in which the toner is used causes the toner particles to become charged with an electrostatic charge (tribocharge). The exact mechanism of development of the toner image will then vary according to the specific device used. For example, in a conventional photocopier the toner composition may be formulated so that tribocharged toner particles will be opposite in sign to the latent image on the drum and toner will be attracted to the latent image on the drum to develop an image in toner on the drum which corresponds to the original document. The developed image is then transferred to a substrate such as paper (e.g. by a pressure roller and/or voltage). The transferred image is fixed to the substrate (e.g. by heat) to produce a hard copy of the image. The image drum is then cleaned and the device is ready to produce the next copy. Thus toner compositions are used both to develop the latent image on the drum and to produce the final hard copy.

Thus it is desirable for toner compositions to comprise particles which can possess readily an electrostatic charge (tribocharge) so they can be attracted to the latent image on the drum to develop the latent image. Toners which readily tribocharge may also have the further advantage of facilitating rapid and more complete removal of any residual toner from the image drum (e.g by electrostatic repulsion). This may improve image quality (by reducing ghost images from previous copies) and may reduce the cycle time between copies and thus increase the speed of copying.

It has been found that the addition of certain charge control agents (hereinafter known as CCA's) to toner compositions helps the production and stability of triboelectric charge within the toner. Use of CCA's may also lead to improved image quality when the latent image is transferred to the paper. The mechanism for the action of CCA's is unclear, but the industry continues to seek compounds with improved abilities as CCA's.

Properties desired in ideal CCA's; toner compositions to which they are added; and/or the hard copies they produce are well known to those skilled in the art. Such properties might comprise any or all of the following: ability to stabilize larger tribocharge; improved tribocharge distribution and/or uniformity of charge within an individual toner particle and/or across the population of toner particles within a toner composition; reduced cost, reduced toxicity or non-toxicity, greater stability under conditions of use, good compatibility with the binder resin in a toner, improved image resolution, greater speed of image production, reduction in print bleed in the hard copy and/or improved colorant properties.

The CCA's currently available are not completely satisfactory in some or all of these respects. Thus it would be desirable to provide CCA's which result in improvements in some or all of the preceding areas.

Naphth[enoxyphenoxy] azo complexes with chromium are known as CCA's for negative toners for example from JP (Kokoku) 61-045,229 and JP (Kokoku) 62-034,516 (both Nippon Kayaku KK).

It had been thought that to be particularly effective as CCA's such metal complexes should comprise chromium, as complexes with other metals were thought to be less effective at stabilizing tribocharge. This was especially true in toners which become negatively charged during use and hence require a CCA which is effective at stabilizing negative electrostatic charge (hereinafter known as "negative CCA's"). However use of heavy metals such as chromium has well known disadvantages.

EP 0,664,493-A (Hodogaya) describes use of a variety of Fe, Co and Cr metal azo complexes which are useful as CCA's for stabilizing positively charged toners. This teaches away from their use as CCA's in negative toners.

Surprisingly and contrary to what would be expected, the applicant has discovered that simple salts of certain iron and cobalt metal complexes are more effective as negative CCA's for stabilizing negatively charged toners than prior art CCA's which are chromium complexes. Toner compositions comprising such CCA's overcome some or all of the above stated disadvantages of the prior art and in particular are substantially free of chromium.

SUMMARY OF THE INVENTION

It is therefore an object of the invention to provide improved, substantially chromium free, electroreprographic toner compositions. According to this object, toner compositions are provided which comprise negative charge control agents according to Formula 1:

Formula I

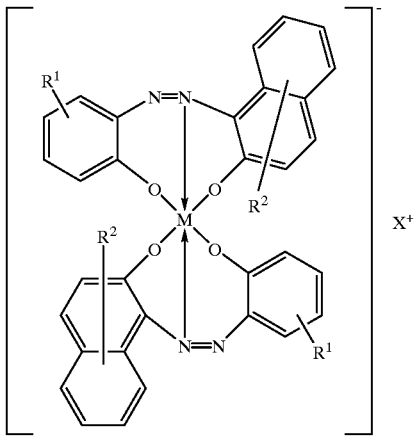

It is another object of the invention to provide improved electroreprographic developer compositions which are substantially chromium free. According to this object, toner compositions are provided which comprise negative charge control agents according to Formula 1.

DETAILED DESCRIPTION OF PREFERRED EMBODIMENTS

The present invention generally relates to an electrereprographic toner, and particularly to a toner for developing electrostatic latent images in electroreprography, the toner capable of being electrified negatively.

In a typical electrereprographic copier, latent images are produced on a photoconductive layer upon exposure to light. These latent images are converted into visible images by developing the latent images with one or more toners. The images are next transferred to a substrate, such as paper, where they typically are fixed by heat.

In non-color copiers, charge control agents are employed to control both the deposition and subsequent removal of the toner from the photoconductive drum. CCA's work by accepting and maintaining an electrostatic charge, commonly called tribocharge. The magnitude, sign and duration of the tribocharge all are important parameters which can be predictive of ultimate usefulness in electrereprographic applications. Moreover, CCA's may be colored complexes that, in addition to their usefulness in maintaining toner quality, may be used to alter of modulate the color of a toner.

In typical color copiers, colored toners are blended in precise ratios to obtain the desired color. The relative amount of each toner deposited on the photoreceptor, and thus blended to obtain a specific color, is strongly affected by the charge level on the toner. A small change in the charge level of any one of the toners can cause an undesirable shift in the final blended color.

Such a shift can be avoided by adjusting certain machine operating conditions, but this adds more complexity to the control conditions. It is, therefore, desirable to control the charge level of the toner, and especially toners for color copying, with added charge control agents.

Typical known charge control agents, however, contain heavy metals such as chromium. Aside from the need to eliminate the associated environmental and health risks of such formulations, there is a need for CCA-containing toner formulations that exhibit improved reprographic quality over the prior art toners in both color and non-color applications.

The present invention therefore provides superior toner compositions containing charge control agents capable of exhibiting a negative electrostatic charge, and which are substantially free of chromium. These compositions exhibit improved reprographic quality and comprise, as a negative charge control agent, one or more azo metal complexes according to the following description.

Charge Control Agents

Negative charge control agents useful in the invention a represented by the complexes of Formula 1:

Formula I

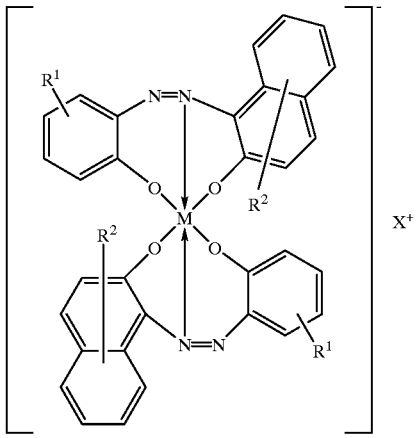

which includes all acceptable forms of such complexes selected from one or more of the following (including mixtures thereof and combinations thereof in the same species); stereoisomers, zwitterions, polymorphic forms, solvated forms, and isotopically substituted forms; and in which:

$X^-$ represents a cation selected from H+, Na+ and mixtures thereof;

M represents a metal selected from Fe and Co;

R' represents a substituent selected from: sulphonyl substituted by one or more $C_{1-4}$alkyl; and sulphamoyl substituted by one or more $C_{1-4}$alkyl; and $R^2$ represents a substituent selected from carboxy and phenylcarbamoyl optionally substituted by one or more $C_{1-4}$alkyl; with the proviso when R' is methylsulphonyl, $R^2$ is other than carboxy.

Complexes of Formula 1 when used in toners of the present invention have particular utility as negative charge control agents and exhibit negative tribocharge results comparable to or better than similar complexes with chromium. Toners of the present invention have improved durability and result in improved print quality over the prior art.

Any radical group mentioned above as a substituent refers to a monovalent radical unless otherwise stated. A group which comprises a chain of three or more atoms signifies a group in which the chain may be straight or branched or the chain or part of a chain may form a ring. The total number of certain atoms is specified for certain substituents for example $C_{1-n}$ alkyl, signifies an alkyl group comprising from 1 to n carbon atoms.

Any hydrocarbon substituent and/or hydrocarbon part of a substituent described herein, for example those listed as alkyl groups above, wholly or in part may be linear, branched, form a ring, including spiro and/or fused rings, and/or may be unsaturated. Unsaturated hydrocarbon substituents or parts of substituents may comprise one or more double and/or triple carbon to carbon bonds and/or optionally may be aromatic in character.

The term "acceptable" or "suitable" as used herein will be understood to comprise those complexes and/or ingredients which if used in a electroreprography or any of the other uses specified herein provide the required properties to the composition and are compatible with any inert carriers and/or diluents suitable for formulating electrereprographic compositions or compositions having any other utility specified herein, for example those described herein. Preferably to be acceptable for use in electroreprography as a negative CCA the complexes of Formula 1 are negative in an Ames toxicity test.

Preferably $R^1$ is positioned at the 5-position on the benzene ring, more preferably is selected from: —$SO_2C2H_5$, —$SO_2NHMe$, and —$SO_2NMe_2$.

Preferably $R^2$ is positioned at the 3-position on the naphthalene ring, more preferably is selected from: —$CO_2H$ and —CONHPh.

Preferably $X^+$ is $H^+$.

Specific complexes of Formula 1 comprise: hydrogen bis {1-[(5-ethylsulphonyl-2-hydroxyphenyl)azo]-3-(phenylcarbamoyl)-2-naphthalenolato (2-)} cobaltate; hydrogen bis {1-[(5-ethylsulphonyl-2-hydroxyphenyl)azo-3-phenylcarbamoyl-2-naphthalenolato (2-)} ferrate; hydrogen bis {1-[(5 -ethylsulphonyl-2-hydroxyphenyl) azo]-3-carboxy-2-naphthalenolato(2-)} cobaltate; hydrogen bis {1-[N-methyl-5-sulphamoyl-2-hydroxyphenyl)azo]-3-phenylcarbamoyl-2-naphthalenolato (2-)} cobaltate; hydrogen bis {1-[(N-methyl-5-sulphamoyl-2-hydroxyphenyl)azo]-3-phenylcarbamoyl-2-naphthalenolato (2-)} ferrate; hydrogen bis {1-[(N,N-dimethyl-5-sulphamoyl-2-hydroxyphenyl)azo]-3-phenylcarbamoyl-2-naphthalenolato (2-)} cobaltate; and suitable mixtures thereof.

The substituents $R^1$ to $R^2$ may be selected to improve the compatibility of the CCA with the toner resins with which they are formulated. Thus, the size and length of the substituents may be selected to optimize the physical entanglement or interlocation with the resin or they may contain reactive entities capable of chemically reacting with the resin.

Certain complexes of Formula 1 may exist as one or more stereoisomers, for example enantiomers, diastereoisomers, geometric isomers, tautomers, conformers and/or combinations thereof, if possible within the same molecular and/or ionic moiety. Complexes of Formula 1 suitable for use in the present invention comprise all acceptable stereoisomers of complexes of Formula 1 and/or any mixtures thereof.

Certain complexes of Formula 1 may exist as one or more zwitterionic forms. Thus, for example, complexes of Formula 1 in which there exists two or more centers of ionic charge may exist as zwitterions. Complexes of Formula 1 suitable for use in the present invention comprise all acceptable zwitterions of complexes of Formula 1 and/or any mixtures thereof.

Certain complexes of Formula 1 may exist as one or more polymorphic forms, for example olathrates, interstitial compounds, crystalline forms, amorphous forms, phases, solid solutions and/or mixtures thereof. Complexes of Formula 1 suitable for use in the present invention include all acceptable polymorphic forms of complexes of Formula 1 and/or any mixtures thereof.

Certain complexes of Formula 1 may exist in the form of one or more solvated forms which may be formed with an acceptable solvent for example where the complexes of Formula 1 and/or the solvent may act as a ligand. Such solvated forms may be non-stoichiometric, for example the degree of solvation may be non-stoichiometric. If the solvent is water, complexes of Formula 1 may exist as hydrates, for example hemihydrates, monohydrates and/or dihydrates. Complexes of Formula 1 may also exist in an un-solvated form, for example an anhydrous form. Complexes of Formula 1 suitable for use in the present invention comprise all acceptable solvated forms of complexes of Formula 1 and/or any mixtures thereof.

Certain complexes of Formula 1 may exist as one or more isotopically substituted forms in which one or more of the commonly occurring isotopes of one or more atoms in complexes of Formula 1 are replaced by an Isotope of the same atom, for example a $^{12}C$ atom may be replaced by a $^{14}C$ atom. Optionally the isotopes may be radio-active. The isotopically substituted forms of complexes of Formula 1 may have utility, in addition to the isotopically unsubstituted compounds, as means for selective imaging in imaging devices, for example devices using X-rays, positron emission tomography and/or nuclear magnetic resonance; as tools to investigate the mode of action of complexes of Formula 1; and/or in any other uses suitable for isotopically labelled complexes of Formula 1. Complexes of Formula 1 suitable for use in the present invention comprise all acceptable, isotopically substituted complexes of Formula 1 and/or any mixture thereof.

Toner Compositions of the Invention

In a further aspect of the present invention, there is provided a composition suitable for use as a colorant and/or charge control agent in electroreprography and comprise one or more complexes of Formula 1 and a suitable carrier and/or diluent; the composition being substantially free of chromium.

Preferably compositions of the present invention are suitable for use as toner compositions and may comprise a resin carrier preferably as a binder. The terms resin and polymer are used herein interchangeably as there is no technical difference between them. The term colorant as used herein encompasses both dyes (which are substantially soluble in the medium to which they are added) and pigments (which are substantially insoluble in the medium to which they are added). A colorant comprises any material which is imparts colour to a medium whether by scattering, absorption and/or reflection of some or all of electromagnetic radiation within the visible range.

The toner resin preferably comprises at least one thermoplastic resin suitable for use in the preparation of toner compositions. More preferably the toner resin comprises one or more of the following: a styrene and/or substituted styrene polymer, such as homopolymer like polystyrene, and/or copolymer like styrene-butadiene copolymer and/or styrene-acrylic copolymer like a styrene-butyl methacrylate copolymer; polyesters, such as specially alkoxylated bisphenol based polyester resins like those described in U.S. Pat. No. 5,143,809; polyvinyl acetate; polyalkenes; poly (vinyl chloride); polyurethanes; polyamides; silicones; epoxy resins; and phenolic resins. Further examples of these and other resins are given in the book "Electrophotography" by R M. Shafert (Focal Press) and in the following patents or patent applications: GB 2,090,008, U.S. Pat. No. 4,206,064 and U.S. Pat. No. 4,407,924. The at least one thermoplastic resin is typically present in an amount ranging from about 85.7% to about 94.3%. Preferable compositions contain from about 90.2% to about 91.3% of the at least one thermoplastic resin. For example, some representative compositions contain from about 86.5% to about 89.5% of a suitable copolymer resin and from about 0% to about 4% of a suitable polyalkene, such as polypropylene or polyethylene.

A toner composition of the present invention comprises one or more complexes of Formula 1, preferably present in the composition from about 0.1 to about 12%, more preferably from about 0.5 to about 10% and most preferably from about 1 to about 3% by weight of the total composition.

Toner compositions of the present invention may also contain one or more suitable dyestuffs and/or pigments as colorant. Optionally the complex of Formula 1 may act as a colorant, either alone or in combination with one or more other colorants. Alternatively, the complex of Formula 1 may be substantially colourless. Other suitable colorants may be selected from one or more of carbon black, magnetite, metallised phthalocyanine, quinacridone, perylene, benzidine, nigrosine, aniline, quinoline, anthraquinone, azo disperse dye, benzodifuranone, metallised lake or pigment toner, water insoluble salts of a basic dye, and any mixtures thereof. The colorant may also be a water soluble basic dye, especially a triphenylmethane dyestuff. The final toner composition may contain up to about 20% colorant and especially from about 4% to about 12% relative to the total weight of the toner resin composition. Some preferred compositions contain colorant from about 7% to about 9%, excluding the optional contribution of one or more complexes according to Formula 1. Some particularly preferred compositions contain from about 7.7% to about 8.3%, exclusive of the complexes according to Formula 1.

When the colorant comprises magnetites or mixture of magnetites and coloured pigment the colorant is preferably present from about 5 to about 70% and more preferably from about 10 to about 50% by weight of the toner resin composition. Mixtures of carbon black and magnetite are available commercially and those containing from about 1 to about 15% are preferred, especially those containing from about 2 to about 6% carbon black based on the weight of carbon black and magnetite. Final toner compositions preferably contain from 4% to 8% carbon black.

Toner resin compositions of the present invention may be prepared by any method known to the art. This typically involves mixing the toner resin with a complex of Formula 1 and optionally a colorant by kneading in a ball mill above the melting point of the resin. Generally, this involves mixing the molten composition for several hours at temperatures from 120 to 200° C., in order to uniformly distribute the complex of Formula 1 and colorant (if present) throughout the toner resin. The toner resin may then be cooled, crushed and micronised until the mean diameter of the particles is preferably below 20$\mu$ and, for high resolution electroreprography, more preferably from 1 to 10$\mu$. The powdered colour toner or toner-resin so obtained may be used directly or may be diluted with an inert solid diluent such as fine particles of silica and/or ferrite by mixing for example in a suitable blending machine to form a developer.

Toner compositions of the present invention may also comprise toner particles prepared chemically by agglomeration, coagulation and/or flocculation techniques. Chemical toners provide a greater degree of control of the properties of resultant particles such as size distribution, particle shape and/or particle composition.

Complexes of Formula 1 may be produced by any suitable method as described in the prior art.

According to a still further aspect of the invention there is provided the use of one or more complexes of Formula 1 as a negative charge control agent in compositions for use in electroreprography the composition being substantially free of chromium, more preferably such compositions are toner compositions.

A yet still further aspect of the present invention provides an electroreprographic device, component for said device and/or consumable for use with said device, which comprises one or more complexes of Formula 1 as a negative charge control agent and which is substantially chromium-free.

Another aspect of the invention provides use of one or more complexes of Formula 1 as a negative charge control agent being substantially chromium-free, in the manufacture of a electroreprographic device, component for said device and/or consumable for use with said device.

The CCA's and toner compositions to which they are added exhibit surprisingly improved properties over those known in the art. These improved properties include: an ability to stabilize larger tribocharge; improved tribocharge distribution; improved uniformity of tribocharge; quicker charging; increased charge stability; and reduced toxicity due to being chromium free.

The invention is further illustrated by the following examples wherein all references are to parts by weight unless indicated to the contrary.

EXAMPLES

Example 1

Hydrogen bis {1-[(5-ethylsulphonyl-2-hydroxyphenyl)azo]-2-naphthalenolato (2-)} cobaltate 2-Amino-4-(ethylsulphonyl)phenol (150.75 g; 0.75 mol) was stirred with water (1,500 ml) and 32% hydrochloric acid (187.5 ml) at <5° C. to which a solution of sodium nitrite (54.34 g; 0.79 mol) in water (100 ml) was added at <5° C. After stirring for 1 hour at <5° C. the excess nitrous acid was destroyed by the addition of sulphamic acid and the pH was adjusted to 3 by adding sodium hydroxide liquor. The resulting diazonium salt was added dropwise to a stirred solution of 3-hydroxy-2-naphthanilide (197.25 g; 0.75 mol in water (100 ml) methanol (1,500 ml) containing sodium hydroxide liquor (75 ml) at <5° C. The reaction mixture was stirred at <5° C. for 1 hour with water and then the pH adjusted to 2 by the addition of 32% hydrochloric acid. The mixture was stirred overnight, filtered and then washed with water to give after drying at 80° C., a red solid (348.7 g; 97.8%, m/z 475) of 4-[(5-ethylsulphonyl-2-hydroxyphenyl) azo]-3-(phenylcarbamoyl)-2-hydroxynaphthalene.

The above prepared monoazo (267.19 g; 0.56 mol) was stirred with water (2,000 ml) and sodium hydroxide liquor (56 ml) for 15 minutes to which a solution of cobalt sulphate $0.7H_2O$ (78.71 g; 0.28 mol) in water was added at 75° C. over 30 minutes. N-methyl-2-pyrrolidone (500 ml) was then added. The resulting reaction mixture was stirred at 75° C. for 30 minutes and the excess acid generated was removed by the dropwise addition of 48% sodium hydroxide liquor. The pH of the reaction mixture was adjusted to 2.6 by the addition of formic acid, and stirred for a further 30 minutes at 75° C. and then filtered and washed with water (1,000 ml). The resultant residue was stirred with water at 75° C. and the pH adjusted to 2.6 by the addition of formic acid. The mixture was stirred at 75° C. for 1 hour, filtered and washed copiously with water to give after drying (at 80° C. in a vacuum oven) a red solid (256.5 g; 91%). of hydrogen bis {1-[(5-ethylsulphonyl-2-hydroxyphenyl) azo]-3-(phenylcarbamoyl)-2-naphthalenolato (2-)} cobaltate.

Example 2

Hydrogen bis {1-[(5-ethylsulphonyl-2-hydroxyphenyl) azo]-3-{phenylcarbamoyl-2-naphthalenolato (2-)} ferrate Hydrogen bis {1-[(5-ethylsulphonyl-2-hydroxyphenyl) azo]-3-{phenylcarbamoyl-2-naphthalenolato (2-)} ferrate was prepared in an analogous manner to the complex prepared in Example 1.

Example 3

Hydrogen bis {1-[(5-ethylsulphonyl-2-hydroxyphenyl) azo]-3-carboxy-2-naphthalenolato (2-} cobaltate Hydrogen bis {1-[(5-ethylsulphonyl-2-hydroxyphenyl) azo]-3-carboxy-2-naphthalenolato (2-} cobaltate was prepared in an analogous manner to the complex prepared in Example 1.

Example 5

Hydrogen bis {1-[(N-methyl-5-sulphamoyl-2-hydroxyphenyl) azo]-3-(phenylcarbamoyl)-2-naphthalenolato (2-)} ferrate Hydrogen bis {1-[(N-methyl-5-sulphamoyl-2-hydroxyphenyl) azo]-3-(phenylcarbamoyl)-2-naphthalenolato (2-)} ferrate was prepared in an analogous manner to the complex prepared in Example 1.

Example 6

Hydrogen bis {1-[(N,N-dimethyl-5-sulphamoyl-2-hydroxyphenyl) azo]-3- (phenylcarbamoyl)-2-naphthalenolato (2-)} cobaltate The above complex was prepared in an analogous manner to the complex prepared in Example 1.

Example 7

Examples 7–19 illustrate the preparation of toner preparations that are made according to the present invention. In this Example a fifteen kilogram toner sample is formulated using 14,670 g of styrene acrylate resin, 30 g of the metal azo complex from Example 3 and 300 g polypropylene wax. The mixture is blended for 60 minutes, extruded at 160° C., coarse ground and then jet milled. The resulting toner is suitable for formulation as a developer by known means.

Example 8

This example demonstrates another toner preparation. A fifteen kilogram toner preparation is formulated using 14,370 g of styrene acrylate resin, 30 g metal azo complex of Example 6, 300 g pigment and 300 g polypropylene wax. The mixture is blended for 60 minutes, extruded at 160° C., coarse ground and then jet milled. The resulting toner is suitable for formulation as a developer by known means.

Example 9

This example demonstrates another toner preparation. A fifteen kilogram toner preparation is formulated by pre-blending 8,669 g of styrene acrylate resin and 1,125 g carbon black for 10 minutes. To this mixture is added 30 g of the metal azo complex of Example 2, 300 g polypropylene wax, and an additional 4,876 g resin. The mixture is blended for an additional 60 minutes, extruded at 160° C., coarse ground and then jet milled. The resulting toner is suitable for formulation as a developer by known means.

Example 10

This example demonstrates another toner preparation. A fifteen kilogram toner preparation is formulated by pre-blending 8,477 g of styrene acrylate resin and 1,125 g carbon black for 10 minutes. To this mixture is added 30 g metal azo complex of Example 1, 300 g polypropylene wax, 300 g pigment and an additional 4,768 g resin. The mixture is blended for an additional 60 minutes, extruded at 160° C., coarse ground and then jet milled. The resulting toner is suitable for formulation as a developer by known means.

Example 11

This example demonstrates another toner preparation. A fifteen kilogram toner preparation is formulated using 14,400 g of styrene acrylate resin, 300 g metal azo complex of Example 6 and 300 g polypropylene wax. The mixture is blended for 60 minutes, extruded at 160° C., coarse ground and then jet milled. The resulting toner is suitable for formulation as a developer by known means.

Example 12

This example demonstrates another toner preparation. A fifteen kilogram toner preparation is formulated using 14,100 g of styrene acrylate resin, 300 g metal azo complex of Example 3, 300 g pigment and 300 g polypropylene wax. The mixture is blended for 60 minutes, extruded at 160° C., coarse ground and then jet milled. The resulting toner is suitable for formulation as a developer by known means.

Example 13

This example demonstrates another toner preparation. A fifteen kilogram toner preparation is formulated by pre-blending 8,496 g of styrene acrylate resin and 1,125 g carbon black for 10 minutes. To this mixture is added 300 g metal azo complex of Example 2, 300 g polypropylene wax, and an additional 4,779 g resin. The mixture is blended for an additional 60 minutes, extruded at 160° C., coarse ground and then jet milled. The resulting toner is suitable for formulation as a developer by known means.

Example 14

This example demonstrates another toner preparation. A fifteen kilogram toner preparation is formulated by pre-blending 8,304 g of styrene acrylate resin and 1,125 g carbon black for 10 minutes. To this mixture is added 300 g metal azo complex of Example 1, 300 g polypropylene wax, 300 g pigment and an additional 4,671 g resin. The mixture is blended for an additional 60 minutes, extruded at 160° C., coarse ground and then jet milled. The resulting toner is suitable for formulation as a developer by known means.

Example 15

This example demonstrates another toner preparation. A fifteen kilogram toner preparation is formulated with 13,230 g of styrene acrylate resin and 975 g carbon black. To this mixture is added 270 g metal azo complex of Example 4, 300 g polypropylene wax, and 225 g pigment. The mixture is blended for 60 minutes, extruded at 160° C., coarse ground and then jet milled. The resulting toner is suitable for formulation as a developer by known means.

Example 16

This example demonstrates another toner preparation. A fifteen kilogram toner preparation is formulated with 13,275 g of styrene acrylate resin and 900 g carbon black, 300 g metal azo complex of Example 3, 300 g polypropylene wax, and 225 g pigment. The mixture is blended for 60 minutes, extruded at 160° C., coarse ground and then jet milled. The resulting toner is suitable for formulation as a developer by known means.

Example 17

This example demonstrates another toner preparation. A ten kilogram toner preparation is formulated with 8,820 g of styrene acrylate resin and 650 g carbon black, 180 g metal azo complex of Example 5, 200 g polypropylene wax, and 150 g pigment. The mixture is blended for 3 minutes, extruded at 160° C., coarse ground and then jet milled. The resulting toner is suitable for formulation as a developer by known means.

Example 18

This example demonstrates another toner preparation. A ten kilogram toner preparation is formulated with 8,820 g of styrene acrylate resin and 650 g carbon black, 180 g of metal azo complex of Example 6, 200 g polypropylene wax, and 150 g pigment. The mixture is blended for 3 minutes, extruded at 160° C., coarse ground and then jet milled. The resulting toner is suitable for formulation as a developer by known means.

Example 19

This example demonstrates another toner preparation. A fifteen kilogram toner preparation is formulated with 13,230 g of styrene acrylate resin and 975 g carbon black, 270 g of the metal azo complex described in Example 1, 300 g polypropylene wax, and 225 g pigment. The mixture is blended for 3 minutes, extruded at 160° C., coarse ground and then jet milled. The resulting toner is suitable for formulation as a developer by known means.

Example 20

This example demonstrates another toner preparation. A uniform mixture of 13,230 g of styrene/acrylate resin, 300 g of wax, 975 g of carbon, 225 g of a suitable pigment and 270 g of the metal azo complex were extruded at 160° C., coarse ground and then jet milled. A toner which is capable of being charged with a negative charge was obtained. The resulting toner is suitable for formulation as a developer by known means.

Example 21 Developer Formulation

The toner of any of Examples 7–20 is mixed with a carrier comprising ferrite particles coated with silicone, to prepare a suitable developer formulation. Thus, 1,050 grams of the toner sample from Example 19, for example, is mixed with 28,950 grams of carrier.

Comparative Example

This Example provides a performance comparison of the metal azo complexes from Examples 1–6. Each of the complexes was formulated in the same representative toner and developer compositions in the following manner.

The toner was mixed with a coated carrier comprising fine iron particles in a respective weight ratio of 6:94 toner to carrier, to prepare an electroreprographic developer formulation referred to herein as "F1".

The toner was mixed with a non-coated carrier comprising fine iron particles in a respective weight ratio of 2:98 toner to carrier, to prepare an electroreprographic developer formulation referred to herein as "F2".

The toner was mixed with a carrier comprising ferrite particles coated with silicone, in a respective weight ratio of 6:94 toner to carrier, to prepare an electroreprographic developer formulation referred to herein as "S1".

The toner was mixed with a carrier comprising ferrite particles coated with silicone, in respective weight ratio of 2:98 toner to carrier, to prepare an electroreprographic developer formulation referred to herein as "S2".

As a measure of performance, each developer formulation of the individual metal azo complexes was subjected to tribocharge analysis. Values were determined in accordance with the well known Toshiba Blow-Off method using a Toshiba TB2OO machine. The results of tribocharge testing of the toner compositions is given in the following table:

| | Tribocharge of developers ($\mu C^{-1}$) | | | |
|---|---|---|---|---|
| Example | F1 | F2 | S1 | S2 |
| 1 | −18.4 | — | −41.1 | −30.3 |
| 2 | −18.6 | −43.0 | — | −26.2 |
| 3 | −17.8 | — | — | — |
| 4 | −19.0 | — | — | — |
| 5 | −16.0 | — | — | — |
| 6 | −20.6 | −42.5 | — | −31.2 |
| A | −11.2 | −36.6 | −39.1 | −21.2 |

Example A shows analogous developers prepared using a prior art chromium containing CCA. In example A developers F1, F2, S1 and S2 were prepared using an analogous method to that described above, in which the cobalt or Iron complexes of the present invention were replaced by hydrogen bis [(5-chlorophen-2-oxy)-1-azo-(naphthal-2-oxy)] chromate. It can be seen that chromium-free CCA's of the present invention produce better negative tribocharge than chromium containing CCA's in a variety of different developers which use different carrier materials.

What is claimed is:

1. An electroreprographic toner composition, comprising at least one binder resin and at least one charge control agent (CCA), wherein said CCA is a metal azo complex according to Formula 1:

Formula I

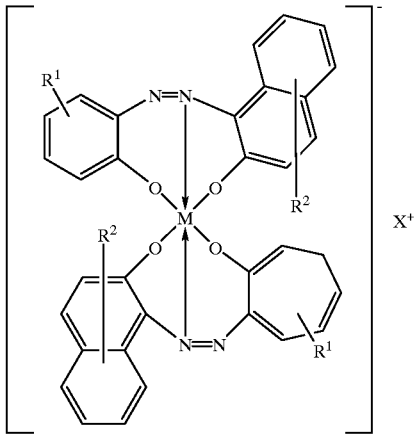

wherein

X+ represents a cation selected from H+, Na+ and mixtures thereof;

M represents Co;

$R^1$ represents a substituent selected from: sulphonyl substituted by one or more C1–4alkyl; and sulphamoyl substituted by one or more $C_{1-4}$alkyl; and $R^2$ represents a substituent selected from: carboxy; and phenylcarbamoyl optionally substituted by one or more $C_{1-4}$alkyl; with the proviso when $R^1$ is methylsulphonyl, $R^2$ is other than carboxy, and wherein said toner composition is substantially chromium free.

2. A toner composition according to claim 1, which further comprises at least one colorant.

3. A toner composition according to claim 1, wherein $R^1$ is positioned at the 5-position on the benzene ring, and $R^2$ is positioned at the 3-position on the naphthalene ring.

4. A toner composition according to claim 3, wherein: $R^1$ is any one of —$SO_2C_2H_5$, —$SO_2NHMe$ or —$SO_2NMe_2$; R2 is —$CO_2H$ or—CONHPh; and X+ is H+.

5. A toner composition according to claim 3 in which the complex of Formula 1 is selected from the group consisting of:

hydrogen bis {1-[5-ethylsulphonyl-2-hydroxyphenyl) azo]-3-(phenylcarbamoly1)-2-napthalenolato (2-)} cobaltate;

hydrogen bis {1-[(5-ethylsulphonyl-2-hydroxyphenyl) azo]-3-carboxy-2-naphthalenolato (2-)} cobaltate;

hydrogen bis {1-[(N-methyl-5-sulphamoyl-2-hydroxyphenyl)azo]-3-phenylcarbamoyl-2-naphthalenolato (2-)} cobaltate;

hydrogen bis {1-[(N,N-dimethyl-5-sulphamoyl-2-hydroxyphenyl) azo]-3-phenylcarbamoyl-2-naphthalenolato (2-)} cobaltate;

and any suitable mixture thereof.

6. A developer composition comprising at least one toner composition according to claim 1, and a suitable carrier and/or diluent.

7. A developer composition according to claim 6, wherein said carrier or diluent comprises iron particles, ferrite particles, or mixtures thereof, optionally coated with silicone.

8. A toner according to claim 2, wherein said resin is present in an amount ranging from about 85.7% to about 94.3% by weight.

9. A toner according to claim 8, wherein said colorant is present in an amount from about 4% to about 12% by weight.

10. A toner according to claim 8, wherein said CCA is present in an amount ranging from about 0.5% to about 10% by weight.

11. A toner according to claim 8, wherein said resin is present in an amount ranging from about 90.2% to about 91.3% by weight.

12. A toner according to claim 9, wherein said colorant is present in an amount from about 7.7% to about 8.3% by weight.

13. A toner according to claim 9, wherein said CCA is present in an amount ranging from about 1% to about 3% by weight.

* * * * *

UNITED STATES PATENT AND TRADEMARK OFFICE

CERTIFICATE OF CORRECTION

PATENT NO. : 6,025,105
DATED : February 15, 2000
INVENTOR(S) : Steven M. Rice et al.

It is certified that error appears in the above-identified patent and that said Letters Patent is hereby corrected as shown below:

Title page,
Item [73], Assignee, after "Toshiba America Business Solutions, Inc., Irvine, Calif.", please insert -- ; Toshiba Corporation, Tokyo, Japan and Zeneca Limited, Manchester, England --.

Signed and Sealed this

Fifteenth Day of April, 2003

JAMES E. ROGAN
*Director of the United States Patent and Trademark Office*